US009814912B2

(12) United States Patent
Sun

(10) Patent No.: US 9,814,912 B2
(45) Date of Patent: Nov. 14, 2017

(54) VEHICLE POWER SOCKET ADAPTER WITH GLASS BREAKER

(71) Applicant: Shanghai Easy-Use Tools Enterprise Co., Ltd., Shanghai (CN)

(72) Inventor: Shiyu Sun, Shanghai (CN)

(73) Assignee: SHANGHAI EASY-USE TOOLS ENTERPRISE CO., LTD., Shanghai (CN)

( * ) Notice: Subject to any disclaimer, the term of this patent is extended or adjusted under 35 U.S.C. 154(b) by 260 days.

(21) Appl. No.: 14/852,696

(22) Filed: Sep. 14, 2015

(65) Prior Publication Data

US 2017/0072230 A1 Mar. 16, 2017

(51) Int. Cl.

| | |
|---|---|
| ***A62B 3/00*** | (2006.01) |
| ***H01R 27/00*** | (2006.01) |
| ***H01R 31/06*** | (2006.01) |
| *H01R 27/02* | (2006.01) |

(52) U.S. Cl.

CPC ..... *A62B 3/00* (2013.01); *H01R 31/065* (2013.01); *H01R 27/02* (2013.01); *H01R 2201/26* (2013.01)

(58) Field of Classification Search

CPC ..... H01R 31/06; B25F 1/006; B26B 11/008; B60R 2022/328; B60R 22/32; B25D 2250/295

See application file for complete search history.

(56) References Cited

U.S. PATENT DOCUMENTS 5,097,599 A * 3/1992 Hasegawa ..... A62B 3/005 30/123
6,418,628 B1 * 7/2002 Steingass ..... A62B 3/005 30/366
6,454,430 B1 * 9/2002 Lin ..... A62B 3/005 362/109
7,028,874 B2 4/2006 Lin
7,351,111 B2 * 4/2008 Cheng ..... H01R 27/02 439/638

(Continued)

FOREIGN PATENT DOCUMENTS

CN 2505314 Y 8/2002
CN 2764676 Y 3/2006

(Continued)

OTHER PUBLICATIONS

Custom Accessories, Inc., RealTree Xtra 12V Lighted Socket With High Speed USB 12V/2.1A, UPC: 77341126942, Custom Accessories—12v USB Socket, Part Number: 10047, Line: CA, retrieved Jul. 16, 2015; available at: http://www.oreillyauto.conrilsite/c/detail/CA00/10047/N0318.oap?ck=Search_N0318_CA_-1_-1&mn=Custom+Accessories&mc=CA&pt=N0318&ppt=C0092.

(Continued)

*Primary Examiner* — David B Thomas
(74) *Attorney, Agent, or Firm* — Coats & Bennett, PLLC

(57) ABSTRACT

A multi-function charging adapter that include a movable forward nosepiece (or "plug"), a rearwardly open main power socket, a glass-breaking mechanism, and optionally an auxiliary charging port. The forward nosepiece acts as part of the electrical circuit of the adapter, and as a shroud for a pointed plunger of the glass-breaking mechanism. Depression of the nosepiece causes the glass-breaking mechanism to automatically move from the cocked state to a released state. Related methods of use are also disclosed.

14 Claims, 7 Drawing Sheets

(56) References Cited

U.S. PATENT DOCUMENTS

| | | | | |
|---|---|---|---|---|
| 7,557,720 | B2 * | 7/2009 | Rubin | A62B 3/005 340/321 |
| 8,146,192 | B2 * | 4/2012 | McGlynn | A62B 3/005 224/162 |
| 8,505,348 | B2 * | 8/2013 | Colasse | A62B 3/005 206/234 |
| 9,243,787 | B2 * | 1/2016 | Petrucelli | F21V 21/26 |
| 9,254,560 | B2 * | 2/2016 | Rubin | B25F 1/006 |
| 9,716,359 | B1 * | 7/2017 | Xu | H01R 31/06 439/577 |
| 2015/0033477 | A1 * | 2/2015 | Rubin | B25D 5/02 7/158 |
| 2016/0038773 | A1 * | 2/2016 | Sun | A62B 3/005 7/144 |
| 2016/0105046 | A1 * | 4/2016 | Chen | A62B 3/00 320/107 |

FOREIGN PATENT DOCUMENTS

| | | | |
|---|---|---|---|
| CN | 203078377 | U | 7/2013 |
| CN | 203218933 | U | 9/2013 |
| WO | 2015054933 | A1 | 4/2015 |

OTHER PUBLICATIONS

Bell Automotive, 12 Volt Chrome Twin Pipes, Product Code: 22-1-39068-8, retrieved Jul. 16, 2015; available at: http://www.bellautomotive.com/12-Volt-Chrome-Twin-Pipes-p/22-1-39068-8.htm.

Erusun, iKKEGOL 2 Way Car Cigarette Lighter Charger Socket Adapter Extension with 2 USB Ports, retrieved Jul. 16, 2015; available at: http://www.amazon.com/iKKEGOL%C2%AE-Cigarette-Lighter-Charger-Extension/dp/B00DWYGG7W.

* cited by examiner

VEHICLE POWER SOCKET ADAPTER WITH GLASS BREAKER

BACKGROUND

This application is related to vehicle power socket adapters, and particularly to an augmented version of such an adapter that includes a glass breaker.

There are many situations where persons in a motor vehicle, such as an automobile, may need to escape from the motor vehicle quickly and safely. This could occur, for example, in the event the motor vehicle was involved in a collision, became immersed in water, caught on fire, and the like. In most motor vehicles, windows present an obstacle to easy escape. If an occupant is unable to open a window in the vehicle, it may be necessary to break the window in as short a period of time as possible while requiring limited strength and range of motion, particularly if the occupant is injured, fragile, weak, and in some instances having a little time or room to break the window.

Further, there are situations where a particular form factor and/or voltage of a vehicle's power socket (e.g., "cigarette lighter outlet") is inappropriate. For example, a user may wish to charge a portable electronic device (e.g., mobile phone, e-reader, music player, etc.) that requires a USB port for charging. Because a vehicle's power socket is typically at twelve volts, which is inappropriate for a USB port, some form of adapter is required. Such adapters are known, but they do not include any glass-breaking function.

Thus, there remains a need for a multiple-function device that provides a power adapter function and that also includes a glass-breaking function. Such a device could be easily reachable to a user in an emergency situation by being simply plugged into a vehicle's existing power socket.

SUMMARY

The present invention provides a multi-function charging adapter that includes a movable forward nosepiece (or "plug"), a rearwardly open main power socket, a glass-breaking mechanism, and optionally an auxiliary charging port. The forward nosepiece acts as part of the electrical circuit of the adapter, and as a shroud for a pointed plunger of the glass-breaking mechanism. Depression of the nosepiece causes the glass-breaking mechanism to automatically move from the cocked state to a released state.

In one or more embodiments, the invention more particularly provides a multi-function charging adapter. The adapter comprises a housing, a nosepiece, a main socket, and a glass-breaking mechanism. The nosepiece is moveably mounted to the housing and extends forward therefrom. The nosepiece is electrically conductive and rearwardly moveable along a longitudinal axis of the housing against a return bias. The main socket is a rearwardly open main socket fixedly mounted at a rearward portion of the housing. The main socket is electrically connected to the nosepiece such that power supplied to the nosepiece is available at the main socket. The main socket may or may not be axially aligned with the nosepiece. The glass-breaking mechanism comprises a plunger, a bias element, and a plunger guide. The plunger has a forward pointed tip and extends along a plunger axis. The bias element applies a forward bias to the plunger. The plunger guide is mounted to the plunger. The glass-breaking mechanism is automatically moveable between a cocked state and a released state in response to rearward displacement of the nosepiece. In the cocked state, the tip of the plunger is disposed inside the nosepiece and the plunger axis is disposed out of alignment with the longitudinal axis at a non-zero angle relative to the longitudinal axis. In the released state, the plunger extends forwardly out the nosepiece such that the tip of the plunger is disposed outside the nosepiece and the plunger axis is disposed in general alignment with the longitudinal axis. The adapter is configured such that more of the nosepiece is disposed in the housing in the released state than in the cocked state In some embodiments, the adapter may further include an auxiliary charging port disposed offset from the longitudinal axis and electrically connected to the nosepiece such that power supplied to the nosepiece is available at the auxiliary charging port. The auxiliary charging port may be a USB port. In some embodiments, the adapter may further comprise a partially exposed cutting blade disposed offset from the longitudinal axis. In some embodiments, the housing may include an internal wall and the glass-breaking mechanism may include a reset spring bounded on one end by the internal wall and on the other end by the nosepiece. The reset spring is configured to provide the return bias to the nosepiece. In some embodiments, the main socket is electrically connected to the nosepiece via the reset spring. In some embodiments, the bias element of the glass-breaking mechanism is an impact spring disposed about the plunger, and the impact spring is disposed closer to the plunger than the reset spring, and the glass-breaking mechanism includes a retention clip affixed to the housing at a non-perpendicular transverse angle to the longitudinal axis, with the retention clip having an aperture through which the plunger extends. The impact spring is disposed about the plunger, and is bounded on one end by the retention clip and on the other end by the plunger guide. In some embodiments, the angle is approximately 5 degrees. In some embodiments, the retainer clip comprises two mirror image halves. In some embodiments, the adapter comprises not more than one auxiliary charging port. In some embodiments, the plunger comprises a shaft having a reduced size section spaced from a tip.

In other embodiments, the present invention provides method(s) of using a multi-function charging adapter. One or more methods include providing power to a rearwardly open main socket of the adapter by plugging a plug of the adapter into a vehicle's power port; wherein the rearwardly open main socket is electrically connected to the plug and optionally aligned therewith along a longitudinal axis; and wherein the adapter includes a glass-breaking mechanism comprising at least a spring biased plunger. The plunger is in a cocked state during the providing the power. The plunger includes a forward tip that is disposed inside the plug when in the cocked state. The method(s) include thereafter, removing the adapter from the vehicle's power port and contacting a glass window of the vehicle with a front face of the plug. Thereafter, the plunger is triggered to automatically forcibly move to a released state by pressing the plug against the window so as to move the plug rearwardly, relative to a housing of the adapter, along the longitudinal axis. In the released state, the tip of the plunger extends forwardly out of the plug. When moving from the cocked state to the released state, the plunger moves forward relative to the housing and forcibly impacts the window.

In some embodiments, the adapter comprises an optional auxiliary charging port, and the providing power further comprises providing power to an auxiliary charging port of the adapter by plugging a plug of the adapter into a vehicle's power port; wherein the auxiliary charging port is electrically connected to the plug and disposed offset from the longitudinal axis. In some embodiments, the moving the plunger from the cocked state to the released state advantageously causes the glass window to break. In some embodiments, the method(s) further comprise thereafter moving the adapter away from the glass window and simultaneously automatically returning the plunger to the cocked state. The method(s) may further comprise again placing the front face of the plug against the window and thereafter again triggering the plunger to automatically forcibly move to a released state by pressing the plug against the glass surface. In some embodiments, the method(s) further comprise, prior to the removing and during the providing power, lighting an indicator light of the adapter.

The various aspects discussed above may be used alone or in any combination. The various apparatus disclosed herein may operate according to any combination of various methods disclosed herein, and vice versa. Further, the present invention is not limited to the above features and advantages. Indeed, those skilled in the art will recognize additional features and advantages upon reading the following detailed description, and upon viewing the accompanying drawings.

DETAILED DESCRIPTION

Figure 1:
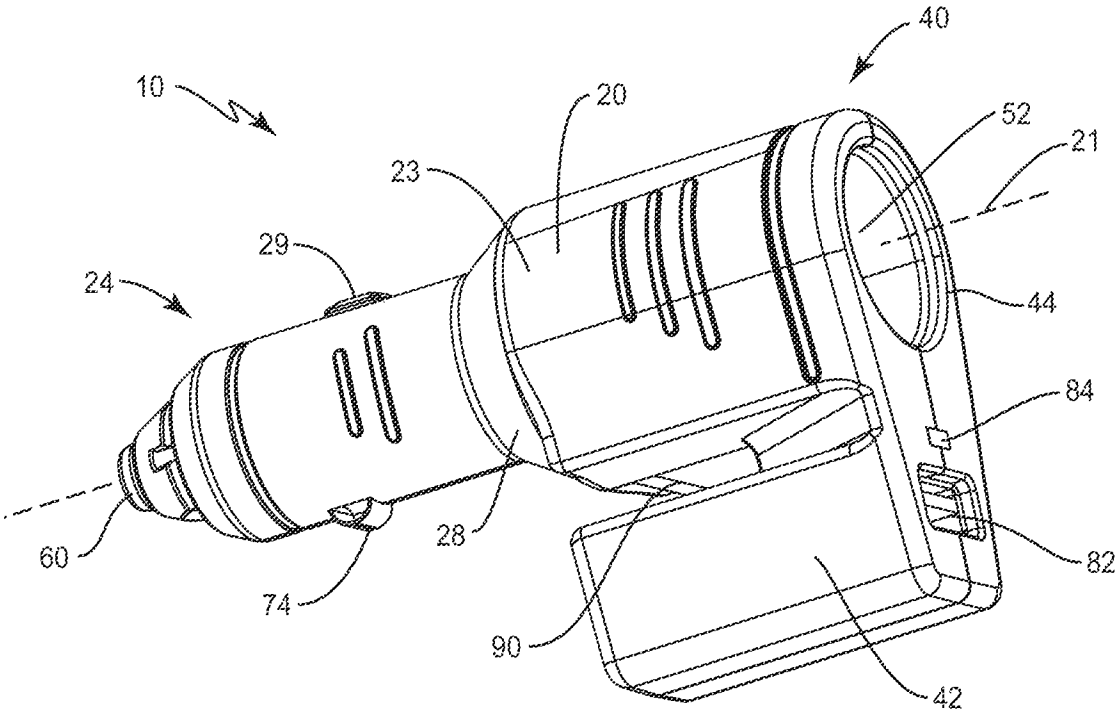
FIG. 1 shows a perspective view of a multi-function charging adapter according to one or more embodiments, with the glass-breaking mechanism in the cocked state.
Figure 2:
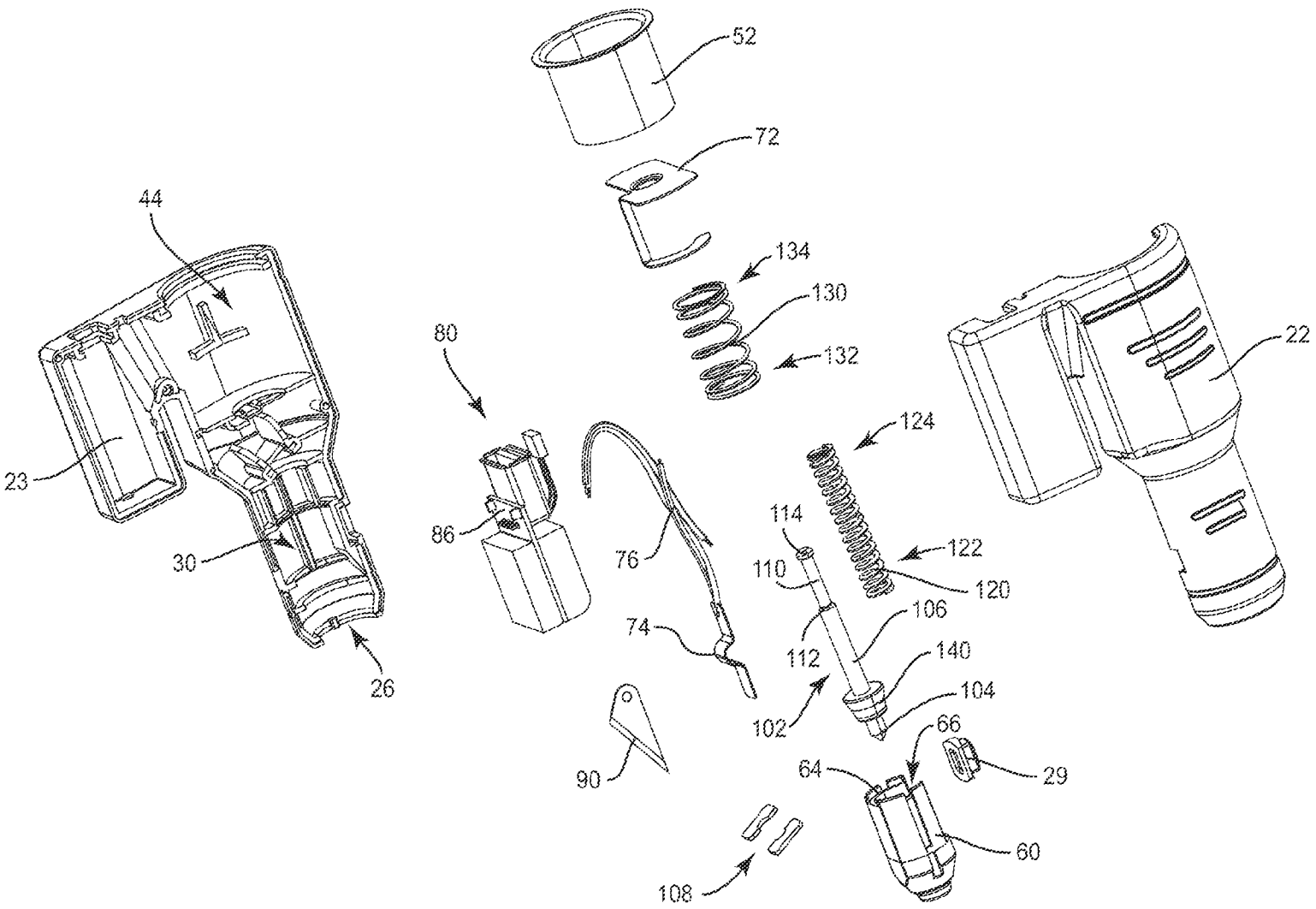
FIG. 2 shows an exploded view of the adapter of FIG. 1.
Figure 3:
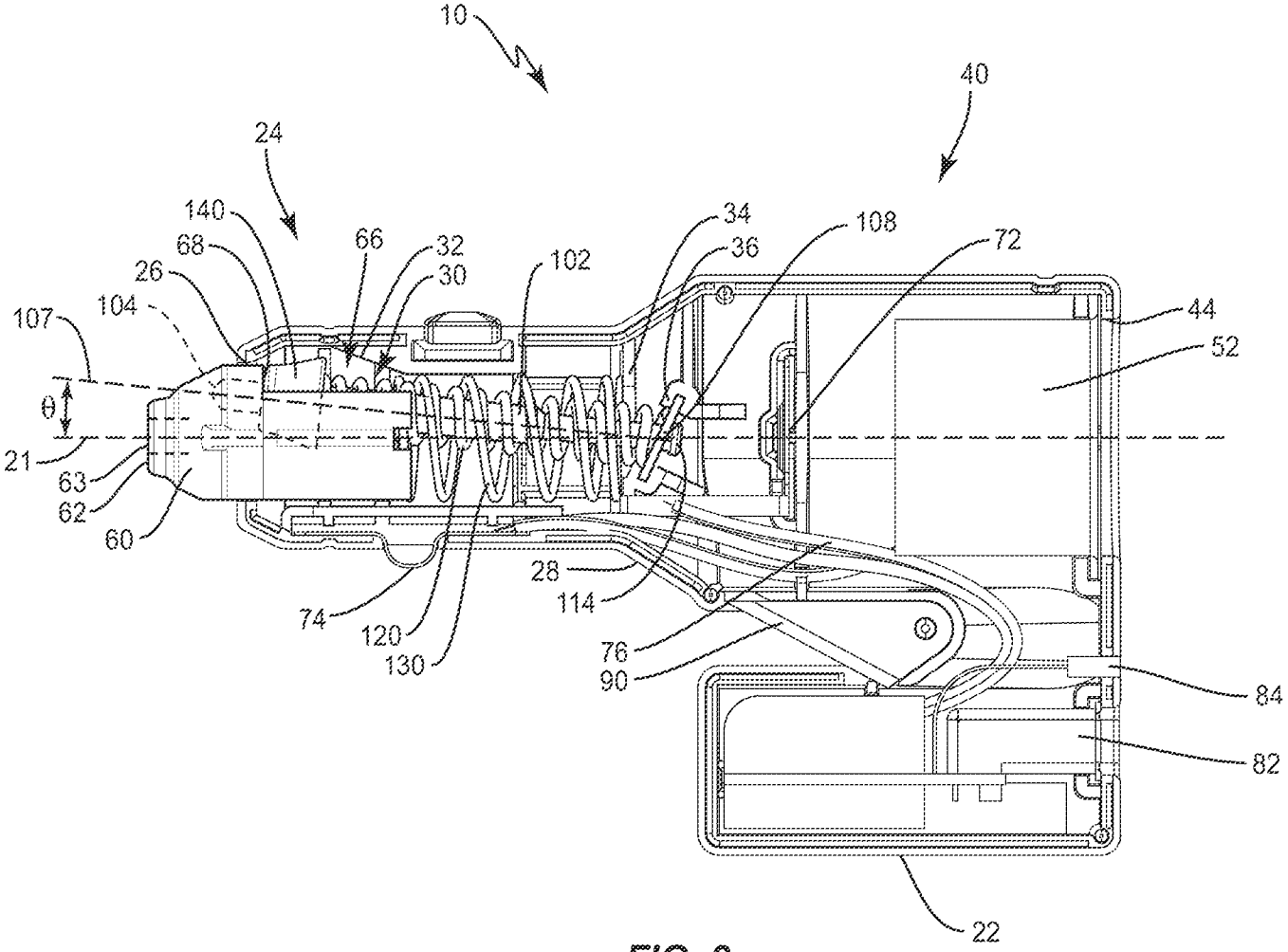
FIG. 3 shows a side view of the adapter of FIG. 1, with one housing half omitted for illustrative purposes, with the glass-breaking mechanism in the cocked state.
Figure 4:
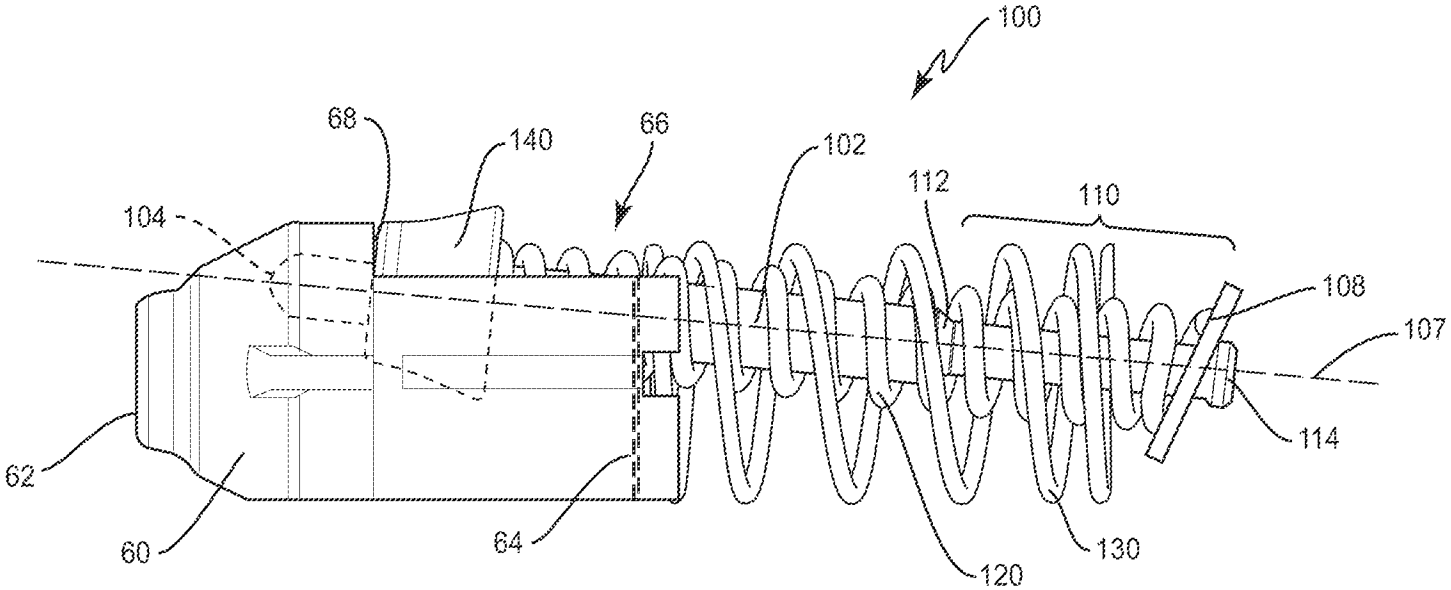
FIG. 4 shows a portion of the glass-breaking mechanism.

The present application is directed to a multi-function charging adapter 10 that includes a movable forward nosepiece (or "plug") 60, a rearwardly open main power socket 52, a glass-breaking mechanism 100, and optionally an auxiliary charging port 82. The forward nosepiece 60 acts as part of the electrical circuit of the adapter 10, and as a shroud for a pointed plunger 102 of the glass-breaking mechanism 100. Depression of the nosepiece 60 causes the glass-breaking mechanism 100 to automatically move from the cocked state to a released state.

Referring to FIGS. 1-7, one embodiment of a multi-function charging adapter is shown, generally indicated at 10. In general terms, the adapter 10 includes a housing 20, electronics, and a glass-breaking mechanism 100. The housing 20 has a forward portion 24 and a rearward portion 40 disposed along a main longitudinal axis 21. Advantageously, the housing 20 is formed of two mated halves—a right half 22 and a left half 23. The forward portion 24 includes an internal chamber 30 for receiving the glass-breaking mechanism 100, as described further below. The forward face of the housing 20 includes an hole 26 aligned with the longitudinal axis 21, with the hole 26 opening directly to the chamber 30. The hole 26 is configured to movably receive the nosepiece or plug 60, as described below. One wall of the chamber 30 includes ramp 32, advantageously formed by an interior surface of an exterior wall of the housing 20. An internal wall of housing 20 forms a spring wall 34 toward the rear of the chamber 30. In addition, a retainer wall 36 is located rearward of the spring wall 34, and configured to have retainer clip 108 mounted thereto. If desired, the forward portion 24 of the housing 20 may include a tapered section 28 proximate the rearward portion 40, and the spring wall 34 and the retainer wall 36 may be located in the tapered section 28. Any or all of the ramp 32, spring wall 34, and retainer wall 36 may be formed in the right half 22, the left half 23, or both the right half 22 and the left half 23 of the housing 20. The rearward portion 40 includes a rear recess 44 for fixedly receiving the main power socket 52. This recess 44 is aligned with the forward hole 26 along longitudinal axis 21. In addition, the rearward portion 40 includes a side boss 42 that houses the auxiliary charging port 82. The side boss 42 is positioned offset from the longitudinal axis 21.

The electronics 50 of the device includes the nosepiece or plug 60, the main power socket 52, the auxiliary charging port 82, and various interconnecting components. See FIG. 7. The plug 60 is electrically conductive, and advantageously has a generally hollow cylindrical shape with a tapered nose. The plug 60 includes a front face 62, a rear shoulder 64, and a side opening 66. The front face 62 faces forward and is disposed normal to the longitudinal axis 21. The front face 62 includes a central opening 63, through which the plunger 102 selectively extends, as discussed below. The plug 60 is movably received in hole 26 so that the plug 60 can be moved linearly back and forth along longitudinal axis 21. The side opening 66 of the plug 60 is disposed in offset relation to the longitudinal axis 21. The side opening 66 includes a ledge 68 on its forward end, which engages with a pin guide 140 of the glass-breaking mechanism 100, as discussed further below. In practice, the plug 60 acts as one contact for transmitting power from a vehicle's power socket to the main power socket 52 and the auxiliary charging port 82. A corresponding side contact 74 is disposed on a side of the housing front portion 24. Together, the plug 60 and the side contact 74 provide opposing "poles" (positive or negative) for allowing the flow of electrical power from the vehicle's power socket (e.g., "cigarette lighter socket"). One path for power is from the plug 60, through an electrically conductive reset spring 130 (discussed below), to an internal contact 72 that functions as a portion of main power socket 52. The corresponding return path is from the main power socket 52, via one or more suitable wires 76, to the side contact 74. Thus, both a positive power path and a negative power path are provided so that the main power socket 52 is able to receive power from the vehicle's power socket when the adapter 10 is plugged thereinto.

The electronics 50 optionally also include the auxiliary charging port assembly 80, which in turn includes the auxiliary charging port 82, an indicator light 84, and a power conversion circuit 86. The auxiliary charging port 82 may take any suitable form, but is advantageously a USB port. The indicator light 84 may take any suitable form, but is advantageously a simple LED or a multi-color LED. The indicator light 84 is configured to indicate when power is supplied to/by the adapter 10. The power conversion circuit 86 is configured to convert the vehicle's power (typically twelve volt) to a different voltage level, such as five volts, so that the auxiliary charging port 82 has the correct voltage supplied thereto. The power conversion circuit 86 is electrically connected to the plug 60 and side contact 72 via suitable wires 76.

The electronics 50 allow the adapter 10 to provide a means to conceptually extend the vehicle's power socket. Further, the electronics 50, in some embodiments, also simultaneously provides an auxiliary charging port 82, which may be a different form factor and/or voltage than the vehicle's power socket.

The adapter 10 also includes a glass-breaking mechanism 100. In general, the glass-breaking mechanism 100 includes the plug 60, a plunger 102, a plunger guide 140, an impact spring 120, and a reset spring 130. The plunger 102 includes a shaft 106 extending along a shaft axis 107, with a pointed forward tip 104 and a rearward retention zone 110. The retention zone 110 includes a reduced size shaft section forwardly bounded by a shoulder 112 and rearwardly bounded by an enlarged tail 114. The plunger 102 is movably retained in housing 20 by a retainer clip 108 mounted to retainer wall 36. The retainer clip 108 is transversely mounted at a non-zero angle relative to longitudinal axis 21, and may be one or multiple pieces (e.g., two mirror image halves as illustrated). The retainer clip 108 has an opening therethrough that is slightly larger than the reduced sized section of the plunger 102, but smaller than both the shoulder 112 and the enlarged tail 114. Thus, the plunger 102 is movably mounted in the housing 20 via the retainer clip 108. In addition, the opening of the retainer clip 108 allows the plunger 102 to change its angle relative to the retainer clip 108, for at least a limited angular distance. The tip 104 of the plunger 102 is designed to impact glass at a point, thereby transmitting mechanical force to the glass so as to break the glass. Thus, the tip 104 should be sharp and formed of hardened steel or the like for best performance.

The plunger guide 140 is affixed to a forward portion of the plunger 102, rearward of the tip 104. The plunger guide 140 takes to form of an annular ring having a forward taper. Thus, the rear edge of the plunger guide 140 is larger than its forward edge.

The impact spring 120 is disposed about the plunger shaft 106 and supplies a forward bias to the plunger 102. The impact spring 120 is compressively captured between the plunger guide 140 and the retainer clip 108. In this regard, the forward end 122 of impact spring 120 is abutting against plunger guide 140, and the rearward end 124 of impact spring 120 abuts retainer clip 108. Due to the relatively angled mounting of the retainer clip 108 and the bias supplied by the impact spring 120, the plunger shaft axis 107, and thus plunger 102, is urged to be disposed at a slightly offset angle θ from the longitudinal axis 21 when the plunger 102 is in the cocked state. This angle is typically in the range of two to six degrees, and advantageously about five degrees. Note that the presence of the side opening 66 in plug 60 allows the plunger guide 140, when the plunger 102 is angled, to extend outside the footprint of the plug 60.

The reset spring 130 is disposed outside of the plunger 102 and the impact spring 120, and is compressively captured between the plug 60 and the spring wall 34 of housing 20. More particularly, the forward end 132 of reset spring 130 abuts against rear shoulder 64 of plug 60, and the rearward end 134 of the reset spring 130 abuts against spring wall 34. The reset spring 130 provides a forward bias to the plug 60. In addition, the reset spring 130 is electrically conductive, and provides an electrical path from the plug 60 to internal contact 72.

Figure 6:
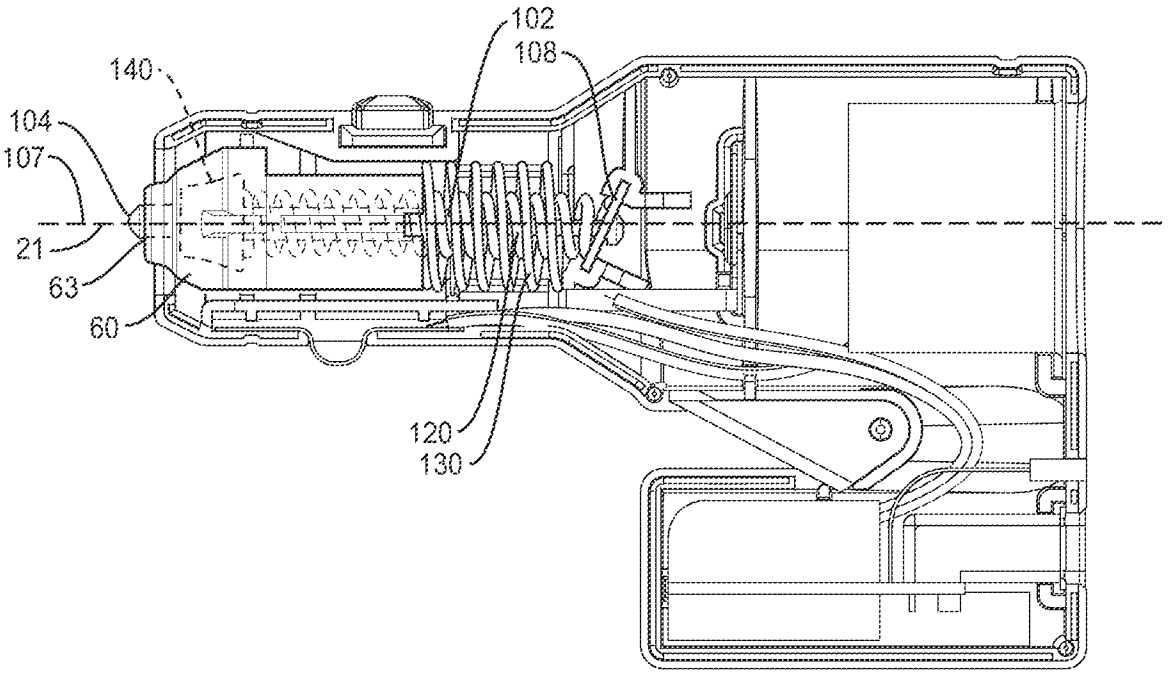
FIG. 6 shows a side view similar to FIG. 3, but with the glass-breaking mechanism in the released state.
Figure 7:
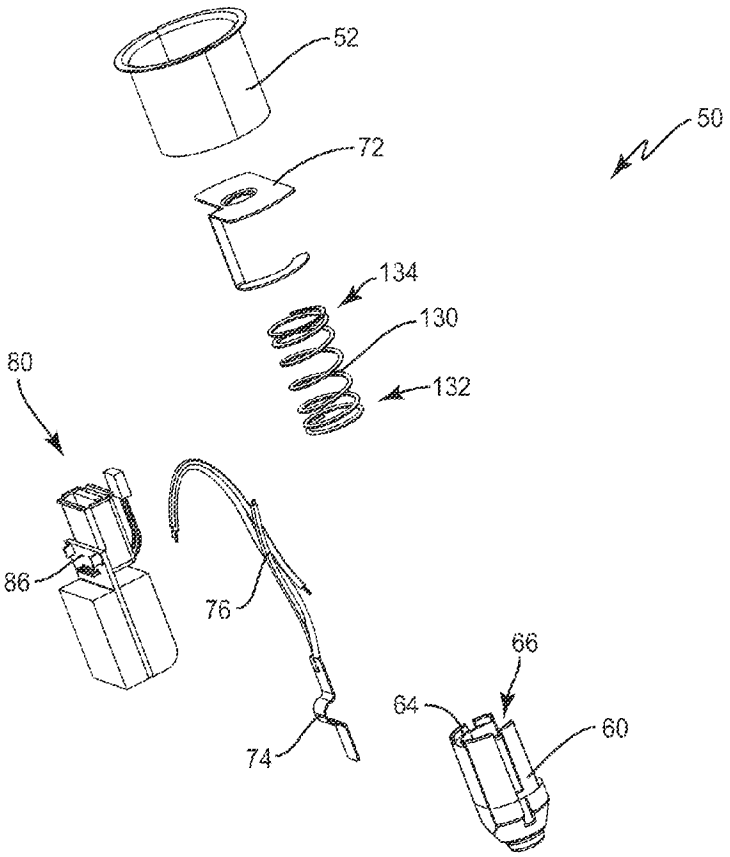
FIG. 7 shows an exploded view similar to FIG. 2, showing electronics components.

The glass-breaking mechanism 100 is moveable between a cocked state (FIG. 3) and a released state (FIG. 6). In the cocked state (FIG. 3), the plunger 102 is disposed at a non-zero transverse angle θ relative to the longitudinal axis 21, and the plunger guide 140 extends outboard of the plug 60 through side opening 66, with the plunger guide's forward face engaging ledge 68 of plug 60. The tip 104 of plunger 102 is inside of plug 60, and is therefore not exposed. The plug 60 is biased to its forward-most position by reset spring 130. This is the typical configuration of the adapter 10 when the adapter 10 is either inserted in the vehicle's power socket, or in the user's hand but not pressed against a window or other surface.

Figure 5:
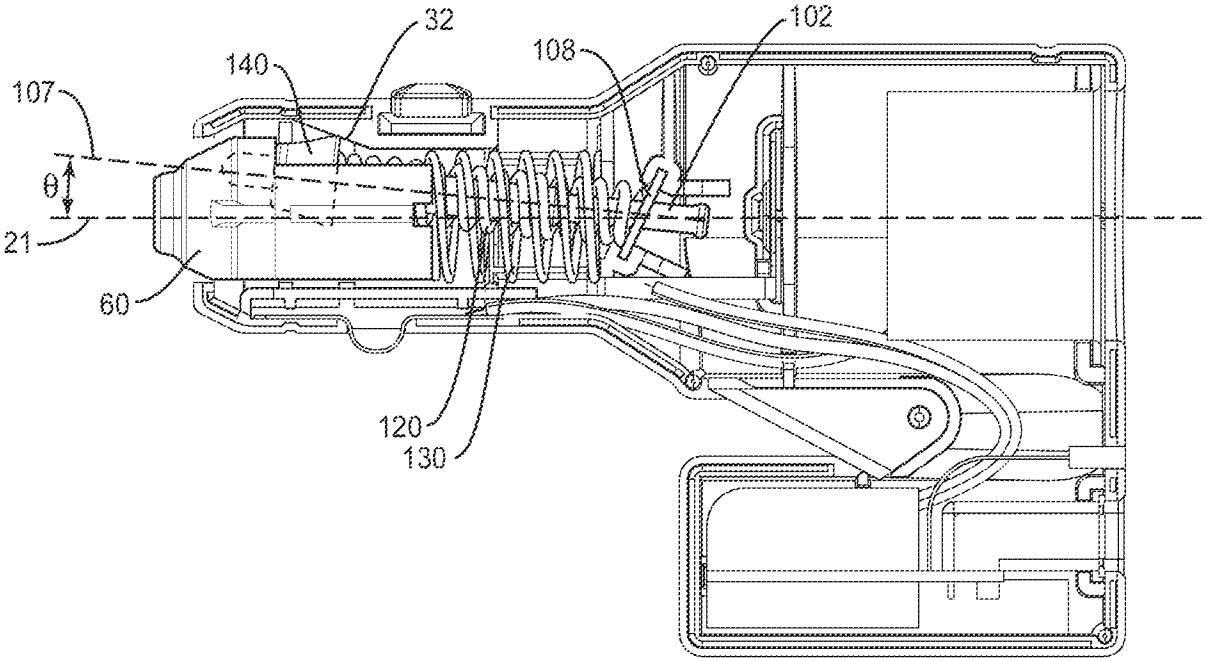
FIG. 5 shows a side view similar to FIG. 3, but with the plug partially displaced rearwardly as the glass-breaking mechanism moves from the cocked state to the released state.

To activate the glass-breaking mechanism 100 from the cocked state to the released state, the user removes the adapter 10 from the vehicle's power socket and presses the front face 62 of plug 60 directly against a window to be broken. When pressed forward by the user against the glass, the plug 60 is moved backward (relative to housing 20) against the bias of reset spring 130, so that more longitudinal length of plug 60 is disposed inside the housing 20. Rearward displacement of the plug 60 moves the plunger guide 140, and thus the plunger 102, rearward due to the interaction of the ledge 68 and plunger guide 140. Note that as the plunger 102 moves rearward, the shaft 106 of plunger 102 moves through the opening in retainer clip 108, and the impact spring 120 is further compressed. At this point, the plunger 102 is still at a slight angle θ to the longitudinal axis 21. As shown in FIG. 5, further rearward displacement of the plug 60 causes the plunger guide 140 to ride against ramp 32, which causes the plunger guide 140 to be displaced inward toward longitudinal axis 21 (downward in FIG. 5). When the plunger guide 140 is displaced inward enough so that plunger guide 140 is released from ledge 68, the plunger 102 is automatically triggered to be deployed forward so that tip 104 extends forward beyond plug 60 and housing 20. To move to the released state, the bias force of impact spring 120 forces plunger 102 forward, and plunger guide 140 guides the plunger 102 so that the plunger 102 becomes aligned with longitudinal axis 21 and tip 104 can be forced forward through opening 63. See FIG. 6. Because the front face 62 of plug 60 is pressed against the glass to be broken, the tip 104 impacts against the glass. The sharpened nature of the tip 104 allows the force thus applied to break the glass. Thus, the glass-breaking mechanism 100 is automatically moveable between the cocked state and the released state in response to rearward displacement of the plug 60 (relative to the housing 20).

The user may then stop pressing the adapter 10 against the glass, and pull the adapter 10 rearward away from the glass. This allows the reset spring 130 to move the plug 60 forward (relative to housing 20), which eventually allows the plunger guide 140 to move into the side opening 66, thereby allowing the plunger 102 to be again angularly offset from the longitudinal axis 21. Thus, the plunger 102 is automatically reset when the plug 60 is moved forward relative to the housing 20.

In some embodiments, the adapter 10 may advantageously include a cutting blade 90 configured to be able to cut seatbelt material. For example, a cutting blade 90 may be affixed to the housing 20 in a corresponding slot disposed in the rearward portion 40 of housing 20 between the longitudinal axis 21 and the auxiliary charging port 82, and associated with the side boss 42. See FIGS. 2-3.

In some embodiments, the adapter 10 may optionally include an externally accessible non-slip pad 29 disposed in the forward portion 24 of housing 20. This pad 29 may assist the user in handling the adapter 10, particularly when the user is pressing the adapter 10 against glass, such as a vehicle window.

The discussion above has generally been in the context of an adapter 10 that includes a main power socket 52 that is sized to receive a "male" insert that is of the same size as the nosepiece 60, with the main power socket 52 fixedly mounted to a rear portion 40 of the housing 20 and disposed in axial alignment with the nosepiece 60 along longitudinal axis 21. However, it should be noted that the main power socket 52 may alternatively, in some embodiments (not shown), be sized differently, such as being a USB port, and/or be fixedly mounted to the housing so as to be offset from the longitudinal axis 21, but still be rearwardly open.

The discussion above has generally been in the context of an adapter 10 that includes an auxiliary charging port 82. However, it should be noted that some embodiments of the adapter 10 may not include an auxiliary charging port 82 (and associated conversion circuit 86, etc.). Thus, the presence of the auxiliary charging port 82 should be considered as optional. As such, some embodiments of the adapter 10 may not include side boss 42. Of course, in some embodiments, the adapter 10 may include more than one auxiliary charging port 82 of the same or different styles. Further, it should be noted that the auxiliary charging port(s) 82 may be oriented and/or disposed on the housing 20 differently than shown in the accompanying figures.

It should be noted that, while the presence of cutting blade 90 is believed advantageous, some embodiments of adapter, with or without one or more auxiliary charging ports 82, may not include cutting blade 90.

The adapter 10 may be made from any suitable materials, such as plastics, metals, or combinations thereof, known in the art. However, as mentioned above, the reset spring 130 and the plug 60 should be electrically conductive, and the plunger 102 should be made of a hard material suitable for breaking glass.

The present invention may, of course, be carried out in other specific ways than those herein set forth without departing from the scope of the invention. The present embodiments are, therefore, to be considered as illustrative and not restrictive.

What is claimed is:

1. A multi-function charging adapter, comprising:

a housing; wherein the housing includes an internal wall;

a nosepiece moveably mounted to the housing and extending forward therefrom, the nosepiece being electrically conductive and rearwardly moveable along a longitudinal axis against a return bias;

a rearwardly open main socket mounted to the housing at a rearward portion of the housing; the main socket electrically connected to the nosepiece such that power supplied to the nosepiece is available at the main socket;

a glass-breaking mechanism comprising:

a plunger having a forward pointed tip and extending along a plunger axis;

a bias element applying a forward bias to the plunger;

a plunger guide mounted to the plunger;

a reset spring bounded on one end by the internal wall and on the other end by the nosepiece; wherein the reset spring is configured to provide the return bias to the nosepiece;

wherein the glass-breaking mechanism is automatically moveable between a cocked state and a released state in response to rearward displacement of the nosepiece;

wherein, in the cocked state, the tip of the plunger is disposed inside the nosepiece and the plunger axis is disposed out of alignment with the longitudinal axis at a non-zero angle relative to the longitudinal axis;

wherein, in the released state, the plunger extends forwardly out the nosepiece such that the tip of the plunger is disposed outside the nosepiece and the plunger axis is disposed in general alignment with the longitudinal axis;

wherein more of the nosepiece is disposed in the housing in the released state than in the cocked state;

wherein the main socket is electrically connected to the nosepiece via the reset spring.

2. The multi-function charging adapter of claim 1, wherein the main socket is axially aligned with the nosepiece along the longitudinal axis.

3. The multi-function charging adapter of claim 1, wherein the adapter further comprises an auxiliary charging port disposed offset from the longitudinal axis and electrically connected to the nosepiece such that power supplied to the nosepiece is available at the auxiliary port.

4. The multi-function charging adapter of claim 3, wherein the auxiliary charging port is a USB port.

5. The multi-function charging adapter of claim 1, further comprising a partially exposed cutting blade disposed offset from the longitudinal axis.

6. The multi-function charging adapter of claim 1:

wherein the bias element of the glass-breaking mechanism is an impact spring disposed about the plunger;

wherein the impact spring is disposed closer to the plunger than the reset spring;

wherein the glass-breaking mechanism includes a retention clip affixed to the housing at a non-perpendicular transverse angle to the longitudinal axis; the retention clip having an aperture through which the plunger extends;

wherein an impact spring is disposed about the plunger;

wherein the impact spring is bounded on one end by the retention clip and on the other end by the plunger guide.

7. The multi-function charging adapter of claim 6, wherein the retention clip comprises two mirror image halves.

8. The multi-function charging adapter of claim 1, wherein the angle is approximately 5 degrees.

9. The multi-function charging adapter of claim 1, wherein the adapter comprises not more than one auxiliary charging port.

10. A method of using a multi-function charging adapter, comprising providing power to a rearwardly open main socket of the adapter by plugging a plug of the adapter into a vehicle's power port; wherein the rearwardly open main socket is electrically connected to the plug;

wherein the adapter includes a glass-breaking mechanism comprising at least a spring biased plunger;

wherein the plug comprises a movable nosepiece; wherein a reset spring biases the nosepiece forwardly; wherein the main socket is electrically connected to the nosepiece via the reset spring;

wherein the plunger is in a cocked state during the providing the power; wherein the plunger includes a forward tip that is disposed inside the plug when in the cocked state;

thereafter, removing the adapter from the vehicle's power port and contacting a glass window of the vehicle with a front face of the plug;

thereafter, triggering the plunger to automatically forcibly move to a released state by pressing the plug against the window so as to move the plug rearwardly, relative to a housing of the adapter, along the longitudinal axis;

wherein, in the released state, the tip of the plunger extends forwardly out of the plug;

wherein, when moving from the cocked state to the released state, the plunger moves forward relative to the housing and forcibly impacts the window.

11. The method of claim 10, wherein the providing power further comprises providing power to an auxiliary charging port of the adapter by plugging a plug of the adapter into a vehicle's power port; wherein the auxiliary charging port is electrically connected to the plug and disposed offset from the longitudinal axis.

12. The method of claim 10, further comprising thereafter moving the adapter away from the glass window and simultaneously automatically returning the plunger to the cocked state.

13. The method of claim 12, further comprising again placing the front face of the plug against the window and thereafter again triggering the plunger to automatically forcibly move to a released state by pressing the plug against the glass surface.

14. The method of claim 10, further comprising, prior to the removing and during the providing power, lighting an indicator light of the adapter.

* * * * *